US008905673B1

(12) United States Patent
Kember

(10) Patent No.: US 8,905,673 B1
(45) Date of Patent: Dec. 9, 2014

(54) MANHOLE COVER

(71) Applicant: Nathan W. Kember, Summerside (CA)

(72) Inventor: Nathan W. Kember, Summerside (CA)

( * ) Notice: Subject to any disclaimer, the term of this patent is extended or adjusted under 35 U.S.C. 154(b) by 0 days.

(21) Appl. No.: 13/782,258

(22) Filed: Mar. 1, 2013

(51) Int. Cl.
*E02D 29/14* (2006.01)

(52) U.S. Cl.
CPC ..... *E02D 29/149* (2013.01)
USPC ..... 404/25; 404/26

(58) Field of Classification Search
CPC . E02D 29/14; E02D 29/1427; E02D 29/1409; E02D 29/1418; E02D 29/1463; E05Y 2900/612; B65D 90/10
USPC ..... 404/25, 26
See application file for complete search history.

(56) References Cited

U.S. PATENT DOCUMENTS

| | | | | |
|---|---|---|---|---|
| 2,109,287 | A * | 2/1938 | Elkington | 404/25 |
| 3,326,100 | A * | 6/1967 | White | 404/26 |
| 3,621,623 | A * | 11/1971 | Downes | 404/25 |
| 3,975,870 | A * | 8/1976 | Naka | 52/20 |
| 5,564,855 | A | 10/1996 | Anderson | |
| 6,484,451 | B1 * | 11/2002 | Gavin | 52/20 |
| 6,695,526 | B2 | 2/2004 | Sondrup | |
| 6,886,577 | B1 * | 5/2005 | Phillips et al. | 137/15.01 |
| 7,171,994 | B1 * | 2/2007 | O'Brien | 141/311 A |
| 7,201,534 | B2 | 4/2007 | Dennis | |
| 7,744,305 | B2 | 6/2010 | Choi | |
| 7,770,333 | B2 * | 8/2010 | Meyers | 52/19 |
| 8,646,210 | B2 * | 2/2014 | Mauriac | 49/402 |
| 2005/0058505 | A1 * | 3/2005 | Nadasde | 404/26 |
| 2007/0031190 | A1 * | 2/2007 | Meyers | 404/26 |
| 2007/0223997 | A1 * | 9/2007 | Fuchs et al. | 404/25 |
| 2009/0241435 | A1 | 10/2009 | Suatac | |

* cited by examiner

*Primary Examiner* — Abigail A Risic
(74) *Attorney, Agent, or Firm* — Robert C. Montgomery; Montgomery Patent & Design

(57) ABSTRACT

A manhole cover adapter system comprises an adapter assembly having a central passage and a wing structure which enables the system is to be embedded between pavement layers during installation. The manhole cover adapter further comprises an expansion joint assembly and, if required, an angular adjustment assembly for allowing uses in various construction scenarios upon various types of manholes.

19 Claims, 7 Drawing Sheets

MANHOLE COVER

RELATED APPLICATIONS

There are no current co-pending applications.

FIELD OF THE INVENTION

The presently disclosed subject matter is directed toward manholes. More particularly the present invention relates to manhole cover adapters for installing manholes and manhole covers in a variety of different construction scenarios.

BACKGROUND OF THE INVENTION

Almost every city has three (3) active levels. The two (2) most often viewed are the street level with its road, signs, and poles, and the upper level with its buildings, towers, and various superstructures. There is however a mostly hidden level, the subsurface level where subways, sewers, and underground utilities such as water, electrical power, communication lines, and the like reside. The number of structures and their scope in the subsurface level would likely be surprising to many.

Access to the subsurface level is usually by way of manholes that are located on paved surfaces such as roadways and parking lots. Such manholes provide ready access to underground features such as water, sewer, electrical power, communication lines, and the like to authorized personnel while restricting access to others. In addition, manholes and their covers provide safety to those operating on the street level. The weight of cars and trucks can easily be handled by a properly installed manhole and its manhole cover. Finally, manholes and their covers provide these features in a manner that is minimally disruptive to overall visual appearances.

In practice, manhole covers are usually located in frames that are set flush with a paved surface, such as a street or parking lot. This is beneficial in that the passage of vehicles, people, and the like can occur safely and with minimal intrusions. However, when such surfaces are repaved it is nearly impossible to adjust the height of the manhole cover frame to match the repaving. Drivers and pedestrians must then deal with sunken manhole covers. About the only practical alternative is a complete manhole cover frame overhaul, which can be very costly and time-consuming.

Accordingly, there exists a need for means by which manholes, their frames, and their covers can be easily adjusted in height to accommodate repaving activities or other actions which cause manholes to be improperly located.

SUMMARY OF THE INVENTION

The principles of the present invention provide a means by which manholes, their frames, and their covers can be easily adjusted in height to accommodate repaving activities or other actions which cause manholes to be improperly located.

A manhole cover adapter that is in accord with the present invention includes an adapter assembly having a cylinder with a center opening, an outward protruding rim, and a flat topped expansion joint housing located below the rim. The expansion joint housing has an inverted "U"-shape cross-section. The manhole cover adapter further includes a wing assembly having a plurality of arms that are attached at one (1) end to the top of the expansion joint housing and outer ends that are attached to a ring. An extending metal mesh is located over the wing assembly. The manhole cover adapter further includes an expansion joint having an inverted "T"-shaped cross-section with a leg that fits into the "U"-shape cross-section. The cylinder is dimensioned to support a manhole cover.

The expansion joint is dimensioned to provide gaps between its vertical surfaces and the expansion joint housing. A dust boot prevents debris from entering the "U"-shape cross-section. Beneficially a flexible rubber pad is disposed between the expansion joint housing and the expansion joint. The rubber pad may be secured to the expansion joint housing using a fastener that passes through a pad aperture.

Preferably the expanded metal layer and the arms are welded to the wing assembly, which maybe circular. In practice the expansion joint housing is beneficially approximately three inches (3 in.) beneath the rim, while the adapter assembly is comprised of a cast metal. If needed an angular adjustment assembly may be placed below the expansion joint. The angular adjustment assembly is beneficially attached to the expansion joint using fasteners and "L"-shaped brackets. If used, the angular adjustment assembly can be attached to an existing manhole structure using "L"-shaped brackets. If the angular adjustment assembly is not used the expansion joint housing may be attached an existing manhole structure using "L"-shaped brackets.

To improve stability at least one (1) brace member can extend between an arm and the expansion joint housing. The at least one (1) brace member may include a second bracket for holding the arm and/or have third bracket attached to the expansion joint housing.

An alternative manhole cover adapter includes an adapter assembly having a center opening that is dimensioned to fit around an existing cylinder. The adapter assembly includes an outward protruding rim and a flat topped expansion joint housing that is located below the rim. The expansion joint housing includes an outwardly protruding, inverted "U"-shape cross-section. The alternate embodiment further includes a wing assembly having a plurality of arms with inner ends attached to the top and outer ends attached to a ring. An extending metal mesh covers the wing assembly and an expansion joint having an inverted "T"-shaped cross-section with a leg that fits into the "U"-shape cross-section. Beneficially the alternative manhole cover adapter includes apertures through the joint housing to enable bolting to the existing cylinder.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
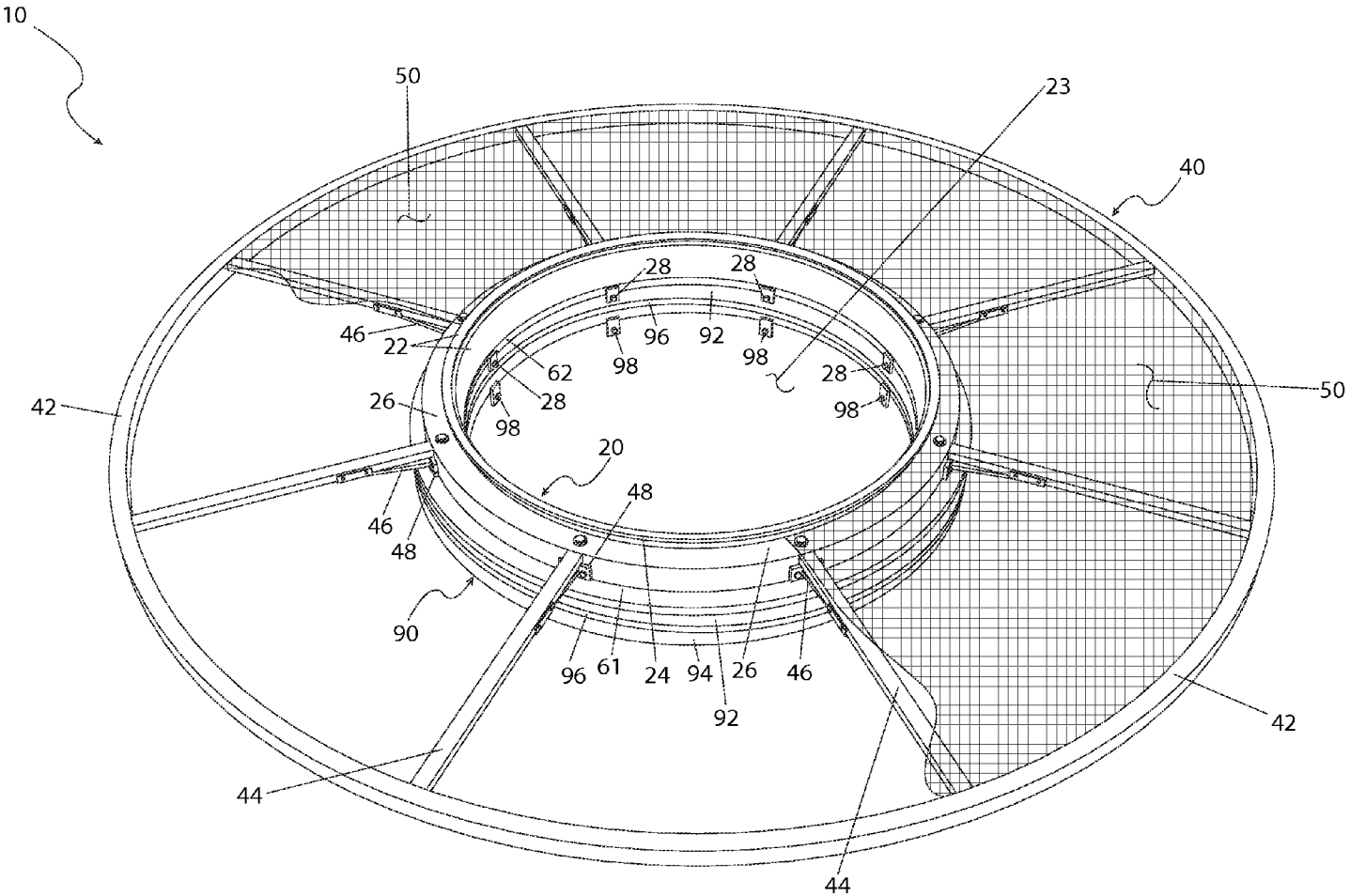
FIG. 1 is a top perspective view of a manhole cover adapter 10 that is in accord with a preferred embodiment of the present invention.

10 manhole cover adapter
20 adapter assembly
22 cylinder
23 first center opening
24 rim feature
25 dust boot
26 first expansion joint housing
28 first bracket
40 wing assembly
42 ring member
44 arm member
46 brace member
47 second bracket
48 third bracket
50 expanded metal layer
60 expansion joint
61 mounting plate
62 support block
64 pad
65 pad aperture
66 pad fastener
80 fastening means
90 angular adjustment assembly
92 upper section
94 lower section
96 joining ring structure
97 second center opening
98 fourth bracket
150 first existing manhole structure
160 second existing manhole structure
165 existing grade ring
200 first pavement layer
210 second pavement layer
215 manhole cover
220 alternate embodiment
222 existing cylinder
224 second expansion joint housing
240 alternate wing assembly
244 alternate arm member
248 alternate third bracket

DETAILED DESCRIPTION OF THE PREFERRED EMBODIMENT

Figure 3:
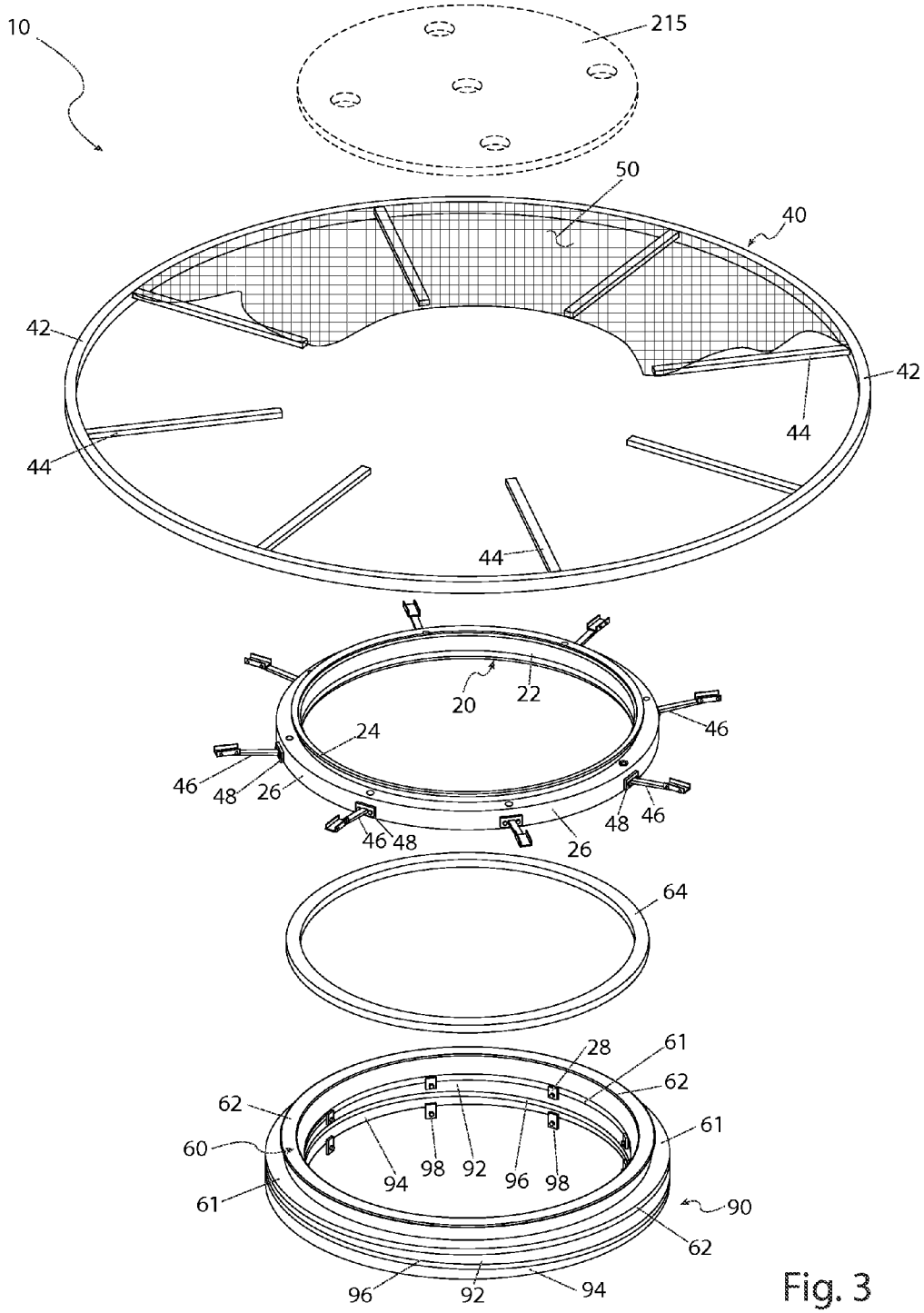
FIG. 3 is an exploded view of the manhole cover adapter 10 shown in FIGS. 1 and 2.
Figure 4A:
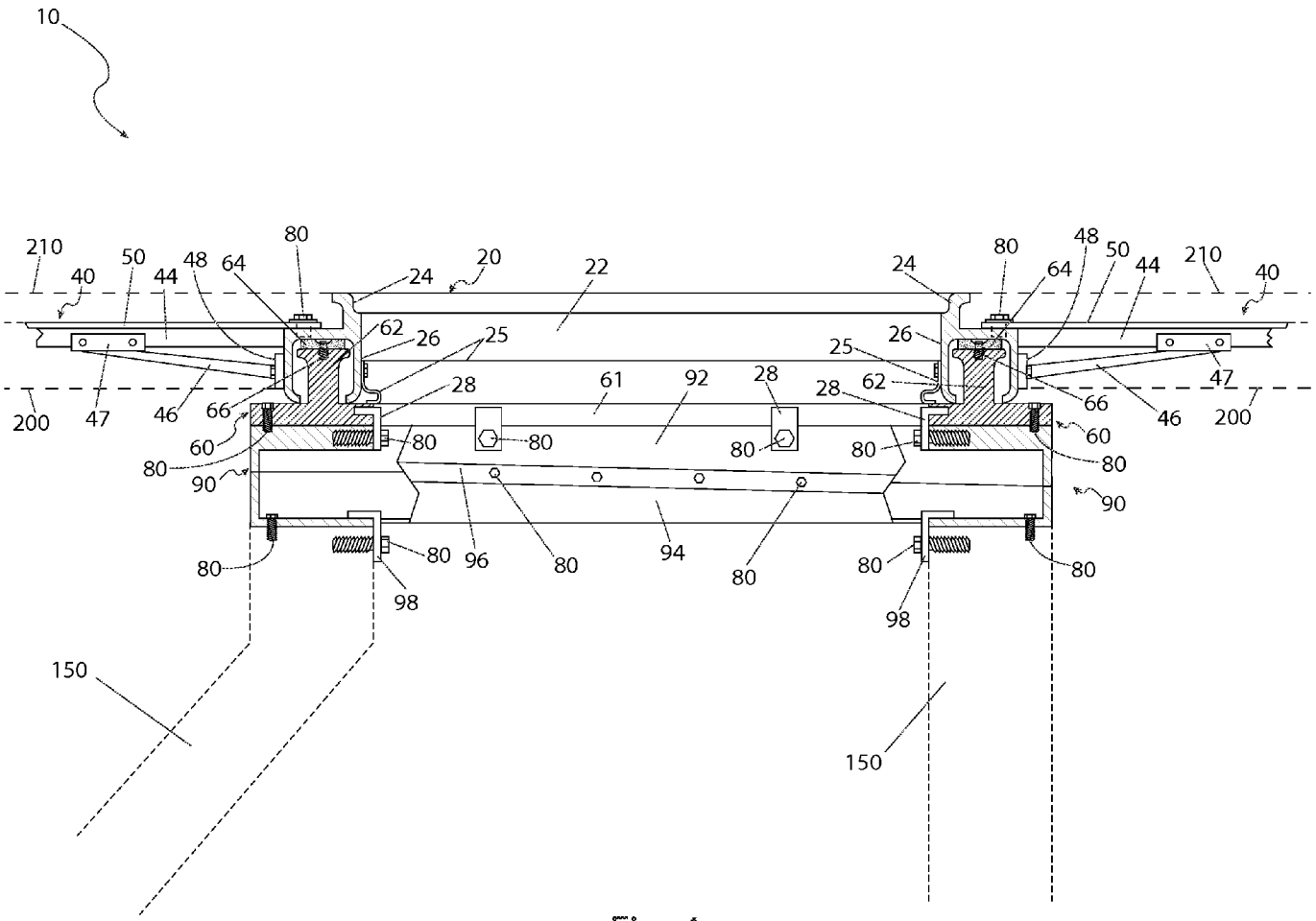
FIG. 4*a* is a section view of the manhole cover adapter 10 shown in FIGS. 1-3.
Figure 4B:
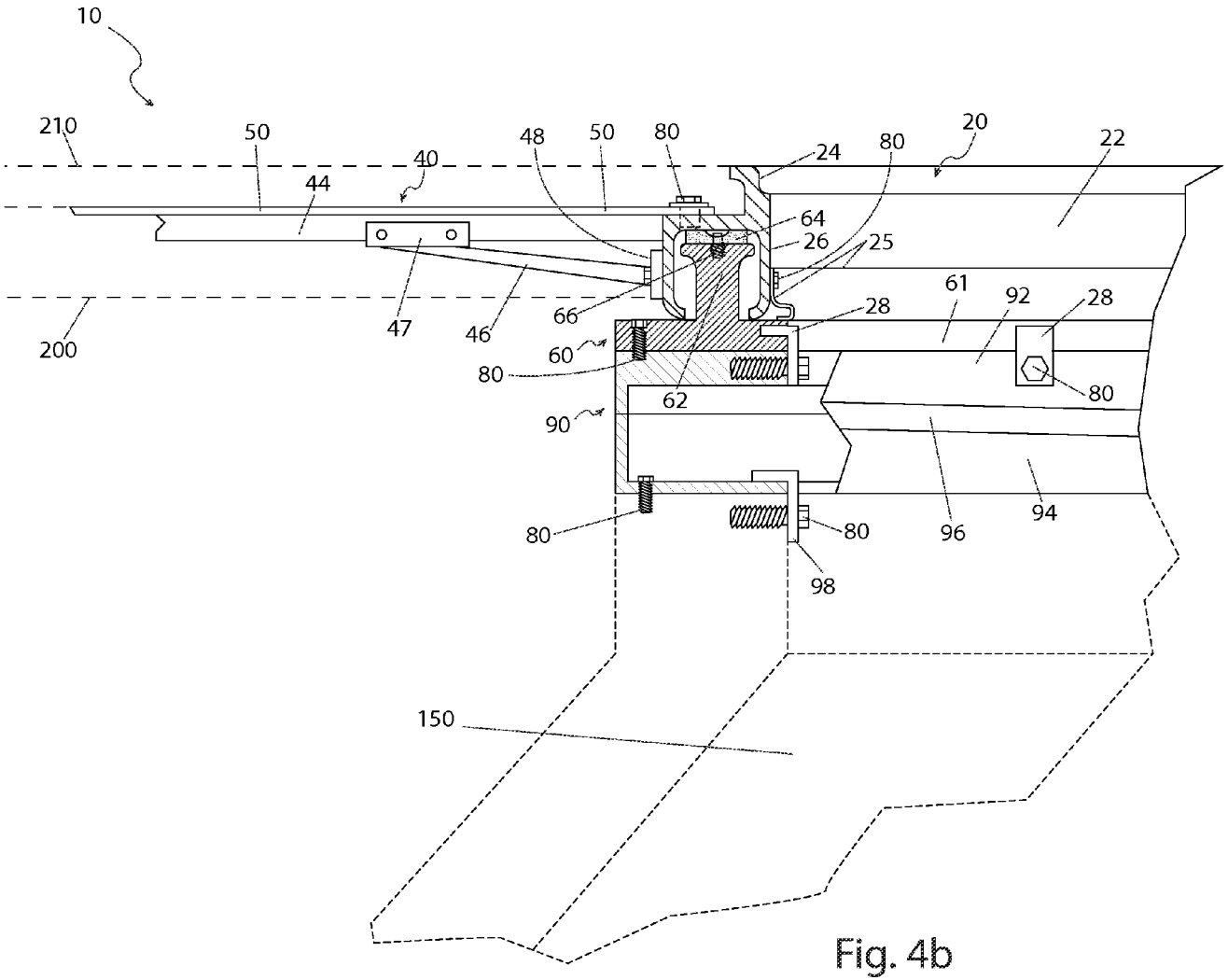
FIG. 4*b* is a close-up section view of the manhole cover adapter 10 shown in FIGS. 1-4*a* depicting use on a height adjustment ring 90.
Figure 5:
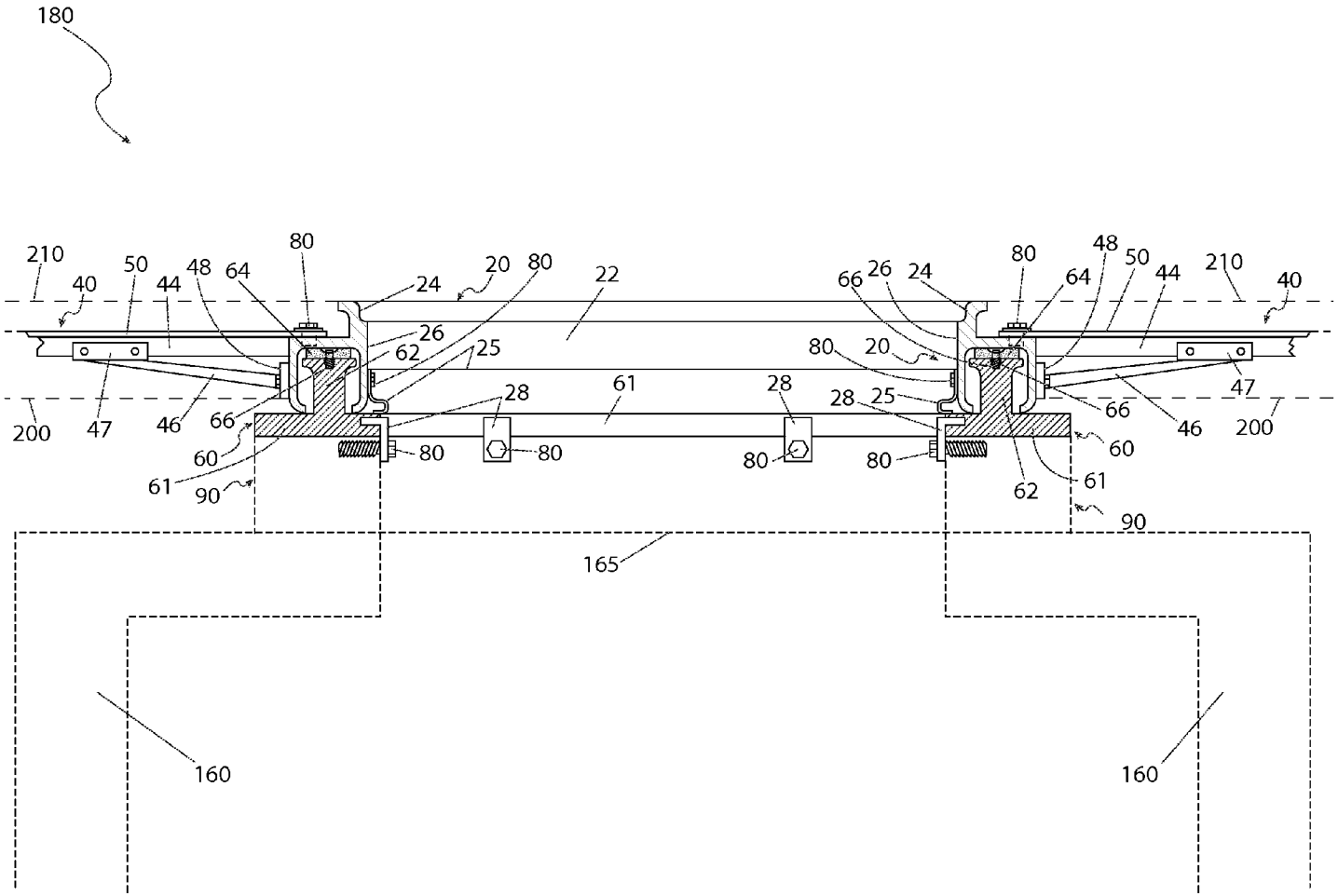
FIG. 5 is a section view of an alternate installation for the manhole cover adapter 10; and, FIG. 6 is a close-up section view of an alternate embodiment 220 of the present invention.
Figure 6:
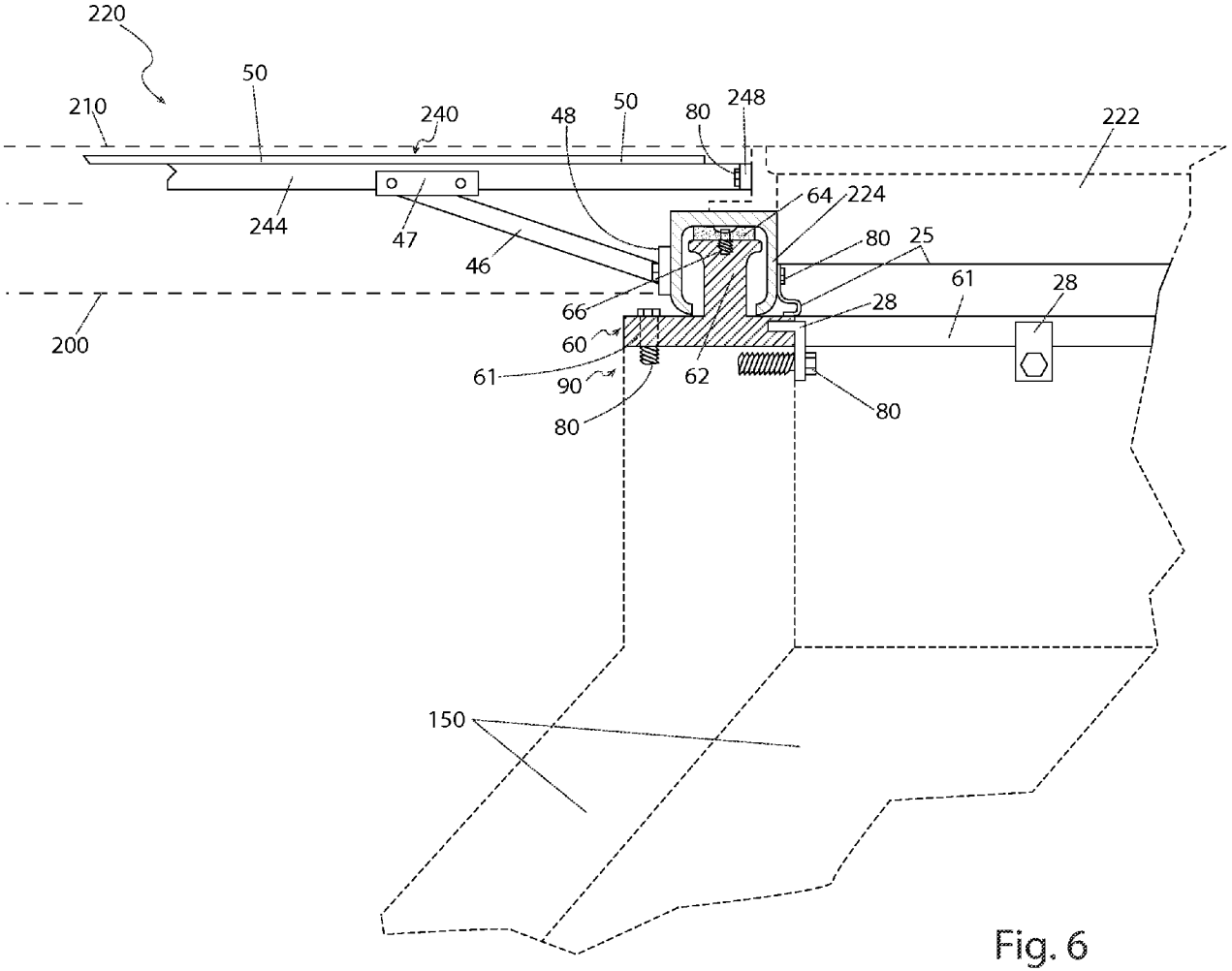

The best mode for carrying out the invention is presented in terms of its preferred embodiment, herein depicted within FIGS. 1 through 4*b*, an alternate installation of that embodiment is shown in FIG. 5, and an alternate embodiment is shown in FIG. 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
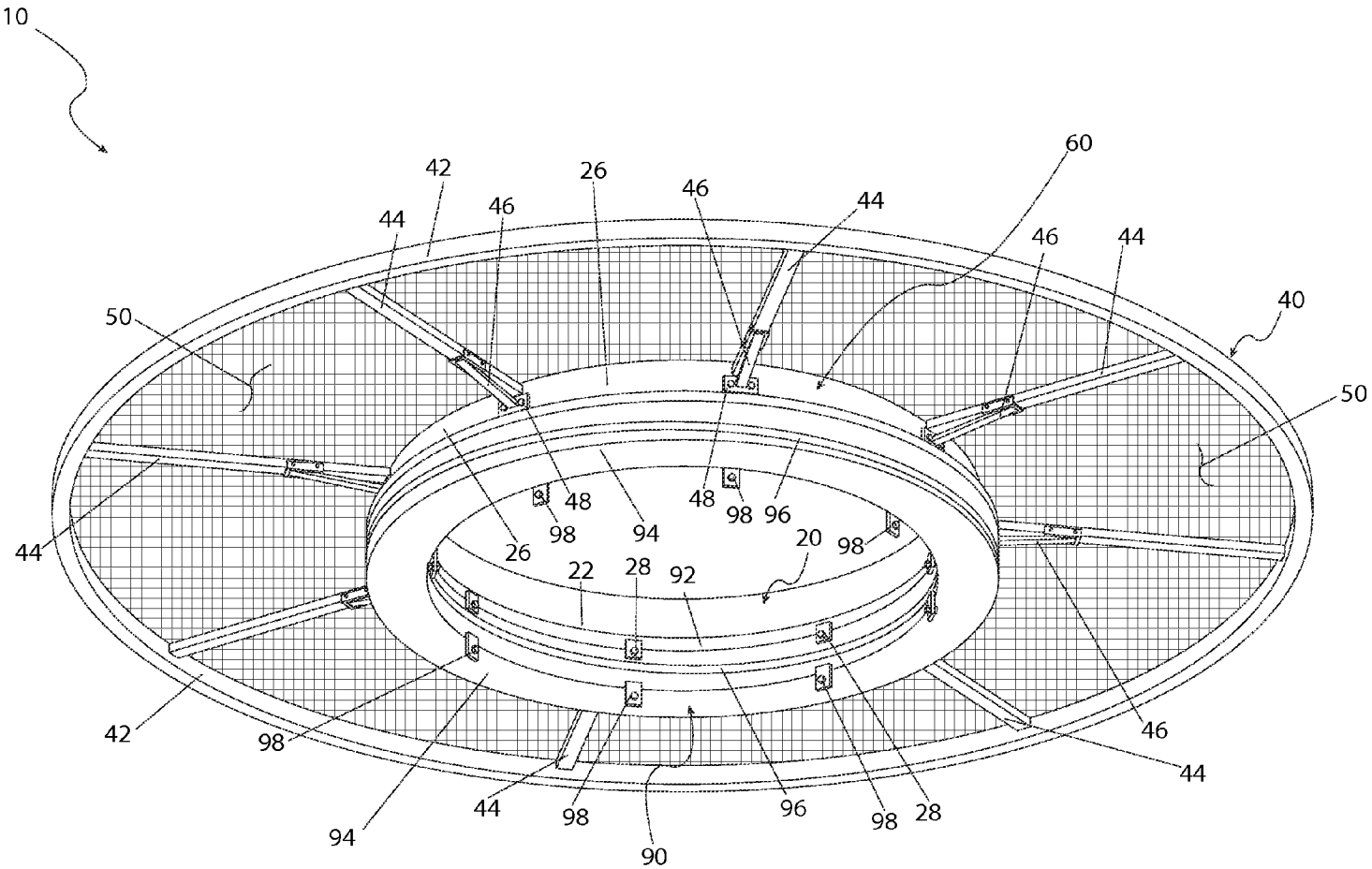
FIG. 2 is a bottom perspective view of the manhole cover adapter 10 shown in FIG. 1.

FIGS. 1, 2, and 3 respectively present top, bottom, and exploded views of a manhole cover adapter 10 which is in accord with a preferred embodiment of the present invention. The manhole cover adapter 10 provides a manhole cover frame system having an inner adapter assembly 20 that supports a manhole cover 215 over re-paved or other road work. The manhole cover adapter 10 further includes a wing assembly 40 attached to the adapter assembly 20 and extending metal mesh 50 over the wing assembly 40. The extending metal mesh 50 and the wing assembly 40 are configured to be positioned between first 200 and second 210 pavement layers during a construction project (see FIGS. 4*a* and 4*b*). The manhole cover adapter 10 also incorporates an expansion joint 60, and possibly an angular adjustment assembly 90, both of which are described in more detail subsequently.

The adapter assembly 20 (illustrated in all FIGS.) is beneficially comprised of steel bar stock. It includes a cylinder 22 having a circularly-shaped first center opening 23 and an outwardly protruding rim 24 (see FIGS. 1 and 3) along its top edge. This circular form is well-suited for use with round manhole covers 215. However, it should be understood that other shapes may be used to support other shapes of manhole covers, such as rectangular. Thus the circular nature of the adapter assembly is not necessarily a factor of the manhole cover adapter 10.

The rim 24 preferably has an inverted "L"-shape with one leg protruding outward from the upper edge of the cylinder 22. This helps anchor and stabilize the manhole cover adapter 10 when placed on a second pavement layer 210 (see FIGS. 4*a* and 4*b*). The cylinder 22 also includes an integral, external first expansion joint housing 26. The first expansion joint housing 26 includes an inverted "U"-shaped cross-section which protrudes outward and down from the main body of the cylinder 22. The inverted "U"-shaped cross-section is configured to receive the expansion joint 60 (as described in more detail subsequently, but see FIGS. 4*a* and 4*b*). The first expansion joint housing 26 has a flat top surface over the inverted "U"-shaped cross-section.

The wing assembly 40 includes a plurality of equally spaced, radially extending arms 44 having inner ends that attach to the first expansion joint housing 26 via a plurality of fasteners 80, such as bolts (again, see FIGS. 4*a* and 4*b*). The outer ends of the extending arms 44 are welded to an outer ring 42. In addition, the wing assembly 40 includes a plurality of brace members 46 that are disposed between the arms 44 near the ring 42 and the first expansion joint housing 26. The arms 44 are held within a second bracket 47 of the end brace members 45, while the brace members 46 also include a third bracket 48 for attaching the brace members 46 to the first expansion joint housing 26. The brace members 46 provide height adjustment and support for the wing assembly 40. The wing assembly 40 is thus a generally circularly shaped, well supported structure (but the shape may change depending on the specific application).

The wing assembly 40 and the first expansion joint housing 26 are configured to be positioned approximately three inches (3 in.) beneath the top of the rim 24 and with the inner ends of the arms 44 resting on the flat top of the first expansion joint housing 26. When the manhole cover adapter 10 is installed the wing assembly 40 is beneficially embedded into position between the first pavement layer 200 and the second pavement layer 210 (see FIGS. 4*a* and 4*b*). In practice the wing assembly 40 is preferably comprised of steel bar stock.

Referring now primarily to FIGS. 4*a* and 4*b*, section views of the manhole cover adapter 10, the expansion joint 60 provides vertical load-bearing as well as compliant relative lateral motion between the remainder of the manhole cover adapter 10 and an existing subjacent manhole structure 150. The vertical loading and lateral motion results from forces applied by traffic, as well as normally occurring thermal expansion and contraction.

The expansion joint 60 is a circular metal structure having an inverted "T"-shaped cross-section. That cross-section is configured such that the leg of the inverted "T" fits into the inverted "U" of the expansion joint housing 26. The expansion joint 60 "T" shape is formed by a rectangular cross-sectioned upper support block 62 and an integral bottom mounting plate 61. The upper support block 62 fits within the inverted "U" of the first expansion joint housing 26. A flexible rubber pad 64 is beneficially positioned between the expansion joint 60 and the first expansion joint housing 26. The rubber pad 64 assists in providing a compliant vertical load support.

The rubber pad 64 is a "donut-shaped," compressible and flexible rubber ring with a rectangular cross-section. The pad 64 is dimensioned to cover the entire top of the support block 62 where it is secured via a plurality of fasteners 80. The pad 64 includes recessed hemispherical pad apertures 65 that contain recessed the heads of the fasteners 80. The fasteners 80 and pad apertures 65 are beneficially arranged in an equally-spaced circular pattern around the pad 64.

As previously noted, in addition to supporting a vertical load the expansion joint 60 supports compliant lateral motion between the manhole cover adapter 10 and a subjacent first existing manhole structure 150. To that end the support block 62 is dimensioned to form a gap between its vertical inner and outer side surfaces and the encompassing first expansion joint housing 26. This allows limited lateral motion due to side-loading and thermal expansion and contraction. Additionally, the expansion joint 60 includes a rubber dust boot 25 which is affixed to the expansion joint 60 by a plurality of fasteners 80. The dust boot 25 prevents debris from entering the interior of the first expansion joint housing 26 which might affect the expansion joint 60 functions.

The expansion joint 60 optionally attaches to an angular adjustment assembly 90. The angular adjustment assembly 90 is envisioned as being similar to units protected under U.S. Pat. No. 5,564,855 (Anderson), and others. As such it has a cylindrical upper section 92, a mating cylindrical lower section 94, a joining ring structure 96, and a second center opening 97 which matches the first center opening 23 of the adapter assembly 20. When used in conjunction with the previously described portions of the manhole cover adapter 10 the angular adjustment assembly 90 supports tilting of the adapter assembly 20 and the expansion joint 60 via relative motion of the upper 92 and lower 94 sections. This beneficially enables the manhole cover adapter 10 to compensate for the slope of the pavement 210.

The angular adjustment assembly 90 attaches at the bottom of the mounting plate 61 of the expansion joint 60 using a plurality of equally-spaced fasteners 80 and "L"-shaped first brackets 28. The "L"-shaped first brackets 28 are attached along the inner vertical sides of the second center opening 97 and the bottom mounting plate 61 using the fasteners 80. The bottom of the angular adjustment assembly 90 is beneficially fastened to a first existing manhole structure 150, shown as a cone-shaped manhole structure. This is accomplished using a plurality of equally-spaced "L"-shaped second brackets 98 which are affixed inside the first existing manhole structure 150 using fasteners 80 to clamp the lower parts of the angular adjustment assembly 90.

FIG. 5 is a section view of an alternate installation of the manhole cover adapter 10 depicting installation upon a second existing manhole structure 160. In addition to the previously described preferred embodiment, the manhole cover adapter 10 may be reconfigured and applied to various manhole structures such as a conventional "flat-top" manhole having an existing concrete grade ring 165 assembly. This construction scenario is especially useful when used in conjunction with a level pavement installation since the angular adjustment assembly 90 is not required. This can reduce cost. Furthermore, it is understood that the teachings of the manhole cover adapter 10 may be utilized for use with various other manhole structures with equal benefit, and as such should not be interpreted as a limiting factor of the manhole cover adapter 10.

FIG. 6 presents a close-up section view of an alternate embodiment 220 manhole adaptor. The alternate embodiment 220 installs a second expansion joint housing 224 and an alternate wing assembly 240 onto an existing manhole cover cylinder 222. The existing cylinder 222 is first bolted to the second expansion joint housing 224 using a plurality of fasteners 80. The alternate wing assembly 240 is then bolted to the outside of the existing cylinder 222. Then the second pavement layer 210 is poured.

The alternate wing assembly 240 provides similar construction and function as the previously described preferred wing assembly 40. However, the alternate wing assembly 240 supports adjustable positioning of the alternate wing assembly 240 based on the height of the existing cylinder 222. The alternate embodiment 220 includes a plurality of alternate arm members 244 that respectively have alternate third brackets 248 that are welded to the ends of the side of the existing cylinder 22. The alternate arms are fastened to the alternate embodiment 220 using fasteners 80. Angular adjustment of the brace members 46 provides height adjustment and support of the alternate wing assembly 240 given different height existing cylinders 222.

It is envisioned that other styles and configurations of the present invention can be easily incorporated into the teachings of the present invention. While only three particular configurations have been shown and described, that is for purposes of clarity and disclosure and not limitation of scope.

The preferred embodiment of the present invention can be utilized by the common user in a simple and effortless manner with little or no training. After initial purchase or acquisition of the manhole cover adapter 10, it would be installed as indicated in FIG. 4*a*.

The method of installing and utilizing the preferred embodiment of the manhole cover adapter 10 may be achieved by: procuring the manhole cover adapter 10; detaching and removing upper portions of the wing assembly 40, including the ring 42, the arms 44, and the expanded metal layer 50, from the brace members 46 by removing the respective fasteners 80; assembling the adapter assembly 20, expansion joint 60, and angular adjustment assembly 90 together, if not previously assembled; placing the assembly onto the top of the first existing manhole structure 150; loosening the fasteners 80 of the joining ring structure 96 and rotating the upper section 92 with respect to the lower section 94 until obtaining a desired angle and orientation of the manhole cover adapter 10 which corresponds to that of an anticipated slope of the pavement surface 210; securing the angle of the angular adjustment assembly 90 by tightening fasteners 80 of the joining ring structure 96; anchoring the angular adjustment assembly 90 to the first existing manhole structure 150 by installing the first brackets 28 and respective fasteners 80 along the second inner opening 97 of the angular adjustment assembly 90; adding foundational road materials around the first existing manhole structure 150; applying the first pavement layer 200; replacing and fastening the previously removed portions 42, 44, 50 of the wing assembly 40 to the brace members 46 using the fastening means 80; embedding the wing assembly 40 within the pavement by applying the second pavement layer 210 up to a level of the rim feature 24 of the adapter assembly 20; installing an appropriately sized manhole cover 215 onto the manhole cover adapter 10; and, benefiting from the combined stabilizing and angularly-adjustable features afforded a user of the manhole cover adapter 10.

The method of installing and using the manhole cover adapter 10, in conjunction with a level pavement scenario, such as upon a second existing manhole structure 160 having an existing grade ring 165 may be achieved in like manner as the preferred installation method; however, without inclusion of the angular adjustment assembly 90.

The method of installing and utilizing the alternate embodiment of the system 220 may be achieved by performing the following additional steps: procuring the alternate embodiment 220; detaching and removing the alternate wing assembly 240, if not previously removed; attaching the existing cylinder 222 to the top of the second expansion joint housing 224 using the fasteners 80; installing the brace member 46, second bracket 47, and third bracket 48 to the side of the second expansion joint housing 224; adjusting and tightening the brace member 46, second bracket 47, and third bracket 48 at a desired angle so as to result in correct positioning of the alternate wing assembly 240; applying the first pavement layer 200; replacing and fastening the previously removed alternate wing assembly 240 to the second brackets 47 using the fasteners 80; attaching the alternate third brackets 248 to the existing cylinder 222 using fasteners 80; applying the second pavement layer 210 up to a desired level embedding the alternate wing assembly 240 and a desired portion of the existing cylinder 222 into the pavement; and, installing an appropriately sized manhole cover 215 onto the existing cylinder 222.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A manhole cover adapter, comprising:

an adapter assembly having a cylinder with a center opening, an outward protruding rim, and a flat topped expansion joint housing below said rim, said expansion joint housing including an outwardly protruding, flat-topped inverted "U"-shaped cross-section;

a wing assembly having a plurality of arms with inner ends attached to a top of said expansion joint housing and outer ends attached to a ring;

an expanded metal layer over said wing assembly; and, an expansion joint having an inverted "T"-shaped cross-section with a leg that fits into said "U"-shaped cross-section;

wherein said cylinder is dimensioned to support a manhole cover; and, wherein said expansion joint is dimensioned to provide gaps between its vertical surfaces and said expansion joint housing.

2. The manhole cover adapter according to claim 1, wherein said expansion joint includes a dust boot for preventing debris from entering said "U"-shaped cross-section.

3. The manhole cover adapter according to claim 1, further including a flexible rubber pad disposed between said expansion joint housing and said expansion joint.

4. The manhole cover adapter according to claim 3, wherein said rubber pad is secured to said expansion joint.

5. The manhole cover adapter according to claim 4, wherein a fastener passes through a pad aperture.

6. The manhole cover adapter according to claim 1, wherein said expanded metal layer is welded to said wing assembly.

7. The manhole cover adapter according to claim 1, wherein said arms are welded to said ring.

8. The manhole cover adapter according to claim 7, wherein said wing assembly is circular.

9. The manhole cover adapter according to claim 1, wherein said top of said expansion joint housing is approximately three inches beneath the rim.

10. The manhole cover adapter according to claim 1, wherein said adapter assembly is comprised of a cast metal.

11. The manhole cover adapter according to claim 1, further including an angular adjustment assembly below said expansion joint.

12. The manhole cover adapter according to claim 11, wherein said angular adjustment assembly is attached to said expansion joint using fasteners and "L"-shaped brackets.

13. The manhole cover adapter according to claim 12, wherein said angular adjustment assembly attaches to an existing manhole structure using "L"-shaped brackets.

14. The manhole cover adapter according to claim 1, wherein said expansion joint is attached to an existing manhole structure using "L"-shaped brackets.

15. The manhole cover adapter according to claim 1, further including at least one brace member extending between an arm and the expansion joint housing.

16. The manhole cover adapter according to claim 15, wherein said at least one brace member includes a second bracket for holding said arm.

17. The manhole cover adapter according to claim 16, wherein said at least one brace member includes a third bracket attached to said expansion joint housing.

18. A manhole cover adapter, comprising:

an adapter assembly having a center opening dimensioned to fit around an existing cylinder, said adapter assembly further including an outward protruding rim, and a flat topped expansion joint housing below said rim, said expansion joint housing including an outwardly protruding, inverted "U" shape cross-section;

a wing assembly having a plurality of arms with inner ends attached to a top of said expansion joint housing and outer ends attached to a ring;

an expanded metal layer over said wing assembly; and an expansion joint having an inverted "T"-shaped cross-section with a leg that fits into said "U"-shaped cross-section;

wherein said expansion joint is dimensioned to provide gaps between its vertical surfaces and said expansion joint housing.

19. The manhole cover adapter according to claim 18, wherein said joint housing includes apertures to enable bolting to the existing cylinder.

* * * * *